US006083038A

United States Patent [19]

Wright

[11] Patent Number: 6,083,038

[45] Date of Patent: Jul. 4, 2000

[54] BRACKET ASSEMBLY

[75] Inventor: John O. Wright, York, Pa.

[73] Assignee: Osram Sylvania Inc., Danvers, Mass.

[21] Appl. No.: 09/129,320

[22] Filed: Aug. 5, 1998

[51] Int. Cl.[7] ..... H01R 13/58

[52] U.S. Cl. ..... 439/473; 439/472

[58] Field of Search ..... 439/473, 472, 439/471, 470, 345, 863, 864, 456, 465, 466, 467, 468, 459

[56] References Cited

U.S. PATENT DOCUMENTS

| | | | |
|---|---|---|---|
| 1,967,091 | 8/1934 | Kempton | 439/468 |
| 3,794,960 | 2/1974 | Sugar | 439/464 |
| 4,869,686 | 9/1989 | Michaels et al. | 439/555 |
| 5,522,735 | 6/1996 | Wright | 439/540.1 |
| 5,620,333 | 4/1997 | Boyle | 439/471 |
| 5,620,334 | 4/1997 | Quilett et al. | 439/471 |
| 5,700,156 | 12/1997 | Bussard et al.. | 439/471 |

FOREIGN PATENT DOCUMENTS

| | | | |
|---|---|---|---|
| WO 82/03296 | 9/1982 | European Pat. Off. | 439/468 |

*Primary Examiner*—Paula Bradley
*Assistant Examiner*—Alexander Gilman
*Attorney, Agent, or Firm*—William H. McNeill

[57] ABSTRACT

A bracket assembly is provided which includes a connector housing and a mating bracket housing. The bracket housing mates with the connector housing in a first mode such that the bracket housing may engage the connector housing in a first locked position. The bracket housing may then be pivoted relative to the connector housing such that the bracket housing engages the connector housing in a second locked position. During such pivoting, the bracket housing bends a conductor that is coupled to the connector housing such that a first length of conductor extends in a first direction and a second length of conductor extends at an angle relative to the first length.

11 Claims, 3 Drawing Sheets

BRACKET ASSEMBLY

TECHNICAL FIELD

The present invention relates to a bracket assembly which is useful in quickly connecting an elongated conductor thereto in such a manner that a first length of the conductor extends in a first direction and a second length of the conductor extends in a second direction which is at an angle relative to the first direction. A method for securing an elongated conductor in this manner is also provided.

BACKGROUND ART

The need for a bracket, which allows an elongated conductor to be bent so that the conductor may be fixed in two directions, is well known. For example the compact nature of a wiring system of an automobile requires bending of elongated conductors and the use of brackets therewith to hold the bent conductors in place. An example of such an elongated conductor is one that is used with an antenna connector for an antenna cable such as that used in the automobile industry for radios. Such conductors typically have a male connector body generally in the form of a plug or a female connector body generally in the form of a ferrule that forms a socket attached to one or both ends thereof. In use, the male connector body is plugged into a mating female connector body to effect a mechanical and electrical connection between the two. Typically the elongated conductor is in the form of a coaxial cable at least one end of which is electrically and mechanically attached to a connector. Cable clamps known in the art for use in forming a right angle connector typically require the use of a dedicated right angle metal sleeve that must be assembled inside of the conventional connector shell. Since a typical application almost always requires straight connectors as well as such right angle connectors, it is necessary to have access to two types of sleeves; that is sleeves for use with such straight connectors and sleeves for use with such angled connectors.

SUMMARY OF THE INVENTION

It is an object of the present invention to provide an improved bracket assembly.

It is a further object of the present invention to provide a bracket assembly which may be used with straight conductors and angled conductors.

Another object of the present invention is to provide a bracket assembly that will retain an elongated conductor therein and provide resistance to axial movement of the conductor relative to the bracket assembly.

Yet another object of the present invention is to provide a bracket assembly which may be easily used in locations where access is not readily available.

Another object of the present invention is to provide an improved bracket assembly for use with an antenna conductor.

A further object of the present invention is to provide an improved method for securing an elongated conductor so that a first length extends in one direction and a second length extends in another direction relative to the one direction.

This invention achieves these and other objects by providing a bracket assembly that includes a connector housing and a mating bracket housing. The connector housing extends in a first direction of a first axis from a connector front to a connector rear. The connector housing is structured and arranged to hold in place a first length of elongated conductor extending in the first direction. A first connector side includes a first camming surface and an opposite second connector side includes a second camming surface. The first connector side also includes a third camming surface and the second connector side also includes an opposite fourth camming surface.

The bracket housing extends in a second direction of a second axis from a bracket top to a bracket bottom. A first bracket side includes a first mating camming surface and an opposite second bracket side includes a second mating camming surface. The first bracket side also includes a third mating camming surface and the second bracket side also includes an opposite fourth mating camming surface.

The bracket housing mates with the connector housing. In a first mode, the first camming surface and the second camming surface engage the first mating camming surface and the second mating camming surface, respectively, sliding being incurred therebetween to first locked positions. In a second mode, the first mating camming surface and the second mating camming surface are rotated relative to the first camming surface and the second camming surface, respectively. The bracket housing thereby bends a second length of elongated conductor, which extends from the connector housing at the rear thereof, until the second length extends in a third direction of a third axis. The third axis extends at an angle relative to the first axis. In the second mode, the third camming surface and the fourth camming surface engage the third mating camming surface and the fourth mating camming surface, respectively, sliding being incurred therebetween.

The present invention also provides a method for securing an elongated conductor so that a first length extends in one direction and a second length extends in another direction relative to the one direction. The method comprises the steps of mating a bracket housing with a connector housing; locking the bracket housing to the connector housing in a first locked position; coupling an elongated conductor to the connector housing so that a first length of the conductor is fixed in one direction; rotating the bracket housing relative to the connector housing, the bracket housing thereby bending a second length of the elongated conductor so that the second length extends in another direction relative to the one direction; and locking the bracket housing to the connector housing in a second locked position so that the second length is fixed in such other direction.

BRIEF DESCRIPTION OF THE DRAWINGS

This invention may be clearly understood by reference to the attached drawings in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
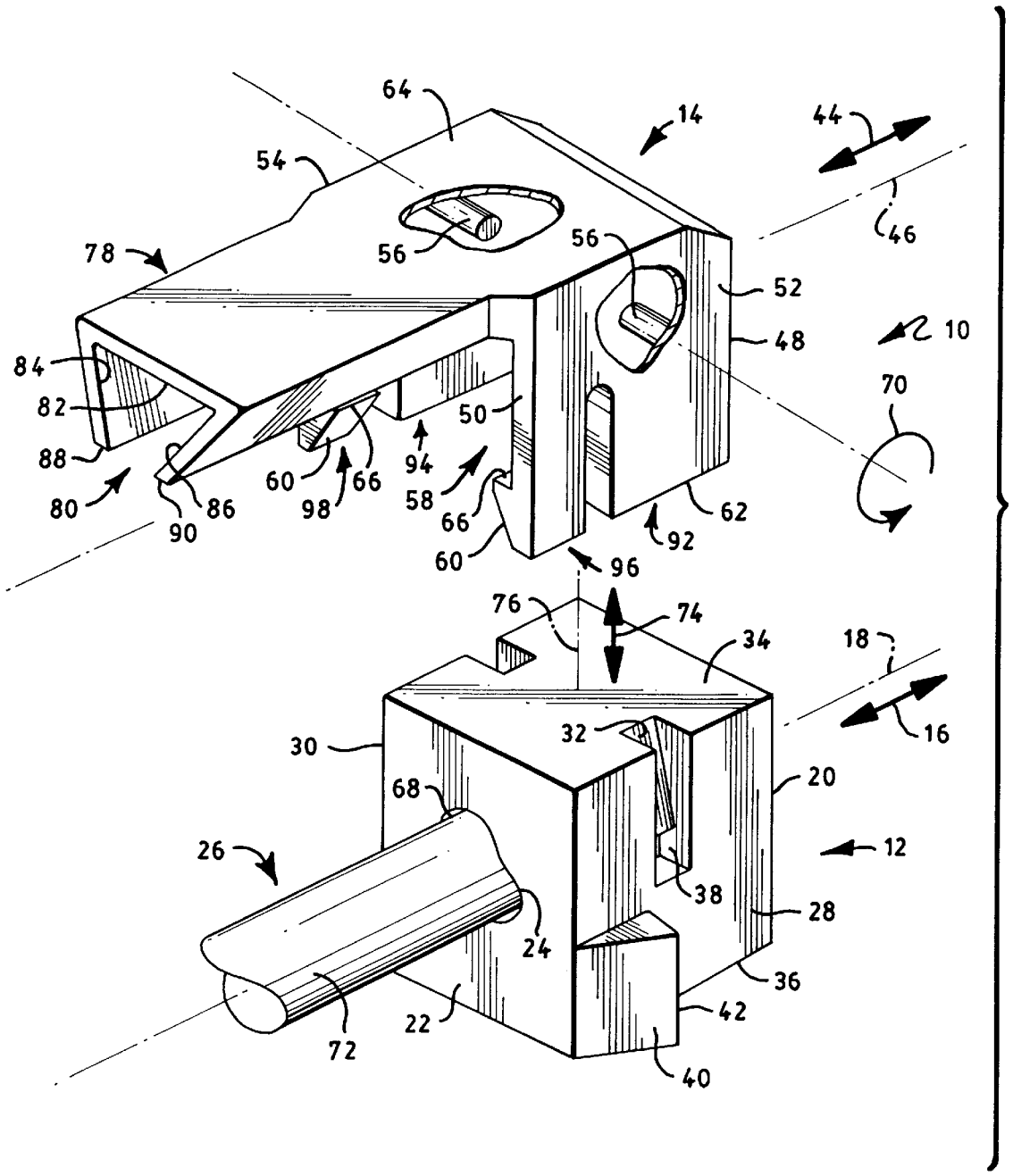
FIG. 1 is an exploded perspective view of one embodiment of a bracket assembly of the present invention, having a conductor coupled thereto, in a first mode.
Figure 2:
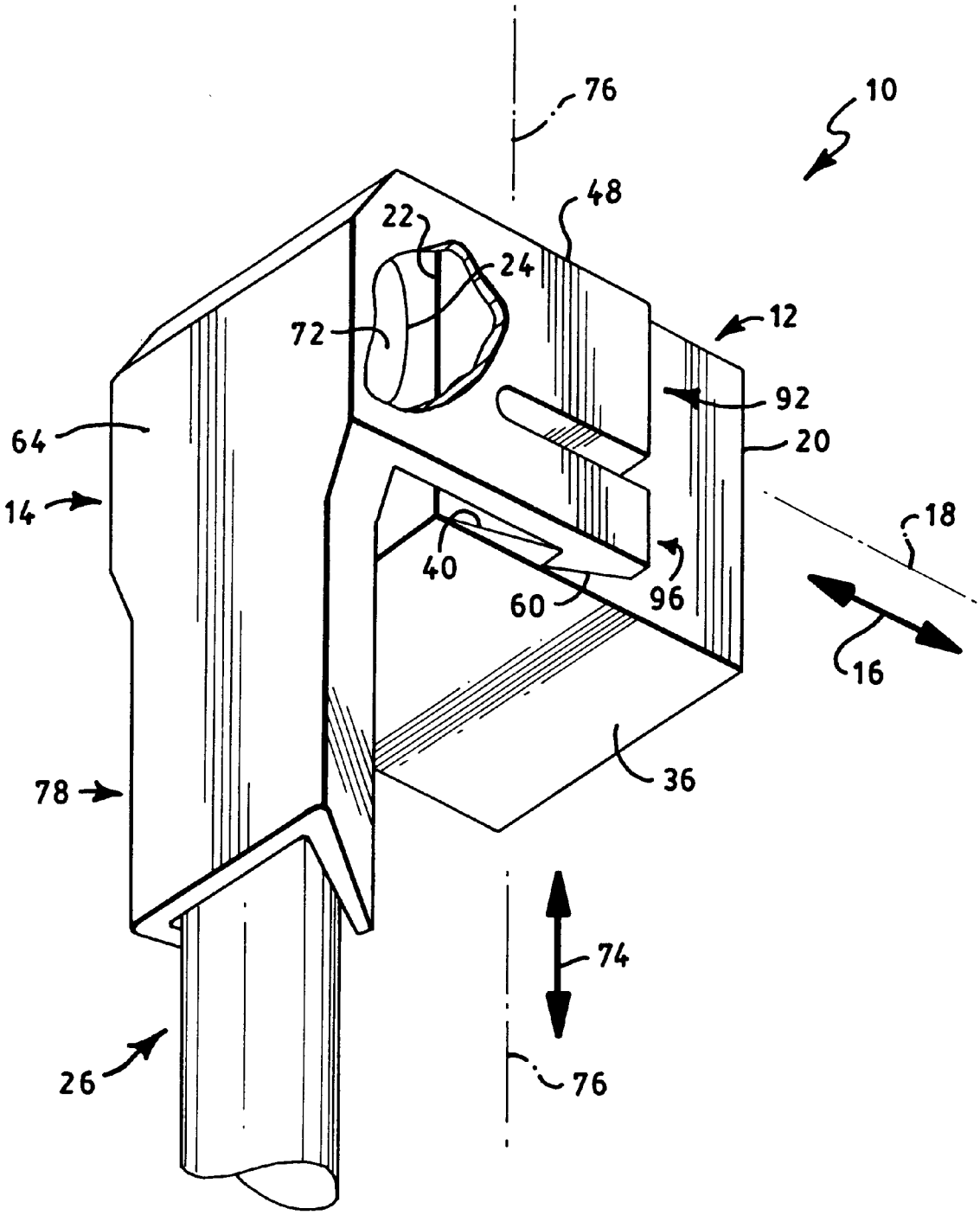
FIG. 2 is a perspective view of the bracket assembly of FIG. 1 in a second mode.

The embodiment of this invention that is illustrated in the drawings is particularly suited for achieving the objects of this invention. FIGS. 1 and 2 illustrate a plastic bracket assembly 10 which comprises a connector housing 12 and a mating bracket housing 14.

Connector housing 12 extends in a first direction 16 of a first axis 18 from the front 20 of the connector housing to the rear 22 thereof. The connector housing of the present invention is structured and arranged to hold in place a length of elongated conductor. For example, the connector housing 12 illustrated in FIGS. 1 and 2 includes a bore 24 which extends in direction 16 from the front 20 to the rear 22 of the connector housing, the bore being structured and arranged to contain a first length of an elongated conductor 26 extending therethrough as described herein. The term conductor as used herein refers to a length of conventional conductor cable such as, without limitation, a coaxial cable; a conventional male or female contact; or a combination of a conventional conductor and conventional contact.

The connector housing of the present invention includes a first side, which includes a first camming surface, and an opposite second side that includes a second camming surface. In a preferred embodiment, the first and second camming surfaces extend from a top of the connector housing towards a bottom thereof. For example, in the embodiment illustrated in FIGS. 1 and 2, the connector housing 12 includes a first side 28 and an opposite second side 30 which include, respectively, first and second cannning surfaces in the form of ramps 32 which extend outwardly from the top 34 of the connector housing towards a bottom 36 thereof. The ramps 32 extend from the top 34 to respective first and second locking recesses 38 that extend into sides 28 and 30 respectively. In the drawings, only ramp 32 and locking recess 38 of side 28 are illustrated, the ramp 32 and locking recess 38 of side 30 being identical thereto.

The first and second sides of the connector housing of the present invention also include a third camming surface and an opposite fourth camming surface, respectively, which in the preferred embodiment extend from the rear of the connector housing towards the front thereof. For example, in the embodiment illustrated in FIGS. 1 and 2, the first side 28 and the second side 30 include, respectively, third and fourth camming surfaces in the form of ramps which extend outwardly from the rear 22 towards the front 20 of the connector housing 12. The ramps 40 extend away from each other from the rear 22 to respective latch walls 42. In the drawings, only ramp 40 and latch wall 42 of side 28 are illustrated, the ramp 40 and latch wall 42 of side 30 being identical thereto.

Bracket housing 14 extends in a second direction 44 of a second axis 46 from the top 48 of the bracket housing to the bottom 50 thereof. The bracket housing of the present invention includes a first side that includes a first mating camming surface and an opposite second side that includes a second mating camming surface. For example, in the embodiment illustrated in FIGS. 1 and 2, the bracket housing 14 includes a first side 52 and an opposite second side 54 which include, respectively, first and second mating camming surfaces in the form of opposing pins 56 which extend into the cavity 58 of the bracket housing from respective sides. In other words, one pin 56 extends into cavity 58 from side 52 towards side 54 and the other pin 56 extends into cavity 58 from side 54 towards side 52.

The first and second sides of the bracket housing of the present invention also include third and fourth mating camming surfaces. For example, in the embodiment of FIGS. 1 and 2, the bracket housing 14 includes third and fourth mating camming surfaces in the form of two opposing ramps 60. Each ramp 60 extends into the cavity 58 of the bracket housing 14 from a respective side 52 and 54. Each ramp extends from the open front 62 of the bracket housing towards the rear 64 to a respective latch wall 66.

In the operation of the bracket assembly of the present invention, a first length of an elongated conductor is coupled to a connector housing so that such first length extends in a first direction. The bracket housing is then mated with the connector housing in a first mode wherein the first and second mating camming surfaces of the bracket housing engage respective first and second camming surfaces of the connector housing and slide in relation thereto to first locked positions. Of course, if desired the first length of elongated conductor may be coupled to the connector housing after the bracket housing is positioned in the first locked position relative to the connector housing. In the embodiment illustrated in FIG. 1, the conductor 26 is a cable having a first length 68 which is inserted into bore 24 so that length 68 extends in direction 16 of axis 18. The first length 68 extends entirely through bore 24 from front 20 of the connector housing 12 to the rear 22, a second length of the cable extending outwardly from the connector housing at rear 22 and a third length of the cable (not shown) extending outwardly from the front 20. Alternatively, the length 68 may include a length of cable electrically and mechanically attached to a conventional contact. In other words, the length 68 may include a male or female contact and a length of cable electrically and mechanically connected thereto in the bore 24 of the connector housing, the combination of the contact and cable length extending from the front 20 to the rear 22, a second length of the cable extending from the bore 24 at the rear 22.

After the conductor 26 has been inserted into bore 24, the bracket housing 14 is mated with the connector housing 12 by moving the bracket housing towards the connector housing until pins 56 engage respective ramps 32. The pins 56 and ramps 32 are structured and arranged such that continued movement of the bracket housing 14 towards the connector housing 12 will cause each pin to slide along a respective ramp such that the pins are cammed away from each other by the ramps. Such movement continues until each pin 56 snaps into a respective locking recess 38 so that the pins are in a respective first locked position.

In a second mode of operation, the bracket housing is rotated relative to the connector housing by rotating the first and second mating camming surfaces of the bracket housing relative to respective first and second camming surfaces of the connector housing. Such rotation causes the bracket housing to bend the second length of conductor extending from the rear of the connector housing until the second length of conductor extends at an angle relative to the first length of conductor. During such rotational movement of the first and second mating camming surfaces of the bracket housing relative to the first and second camming surfaces of the connector housing, the third and fourth mating camming surfaces of the bracket housing engage respective third and fourth camming surfaces of the connector housing and slide in relation thereto to second locked positions. For example, in the operation of the embodiment of the present invention illustrated in FIGS. 1 and 2, bracket housing 14 is rotated relative to connector housing 12 by rotating the pins 56 relative to respective locking recesses 38 in direction 70. Such rotation causes the bracket housing 14 to bend a second length 72 of conductor 26 which extends from the bore 24 at the rear 22 of the connector housing 12 until the second length of conductor extends in the direction 74 of axis 76 as illustrated in FIG. 2. In the embodiment illustrated in FIG.

2 conductor length 72 extends at a 90° angle relative to conductor length 68 although other angular relationships may be provided. During such rotational movement of bracket housing 14 relative to connector housing 12, each ramp 60 will engage a respective ramp 40. The ramps 40 and 60 are structured and arranged such that relative movement in direction 70 between the connector housing 12 and the bracket housing 14 will cause each ramp 60 to slide along a respective ramp 40 such that the ramps 60 are cammed away from each other by the ramps 40. Such rotational movement continues until each latch wall 66 snaps against a respective latch wall 42 so that each pair of ramps 40, 60 is in a respective second locked position. FIG. 2 illustrates the bracket assembly 10 in the second mode wherein the first length 68 (not shown) of conductor 26 extends in the direction 16 of axis 18 into bore 24, the second length 72 of conductor 26 extends in the direction 74 of axis 76, and each pair of ramps 40, 60 is in a locked position. The bracket assembly 10 may be mounted to a supporting structure such as, for example, a supporting surface of a motor vehicle, in any conventional manner. Engagement of the second length of the elongated conductor, and the bending thereof, by the bracket housing 14 may be facilitated by providing the bracket housing with an arm into which the second length of conductor extends. For example, in the embodiment of FIGS. 1 and 2, an arm 78 extends in direction 44 of axis 46 from the bottom 50 of the bracket housing. Arm 78 includes a channel 80 that extends in direction 44. Channel 80 is structured and arranged to contain length 72 of the conductor 26. In particular, channel 80 is structured and arranged such that the channel will engage and contain therein length 72 during the first mode. In the second mode, channel 80 will contain length 72 therein and will cause length 72 to bend so that length 72 extends in direction 74 as described herein. In a preferred embodiment, the bracket housing 14 is attached to the connector housing 12 in the first locked position as described herein and then the conductor 26 is inserted through the channel 80 of the arm 78 and bore 24 before the bracket housing is rotated in direction 70 to bend the second length 72 and engage the connector housing in the second locked position. Alternatively, the conductor 26 may first be inserted into bore 24 and the bracket housing 14 then attached to the connector housing 12 in the first locked position as described herein. Such attachment will cause the second length 72 to be captured by the channel 80 in the first mode of operation. For example, in the embodiment illustrated in FIGS. 1 and 2, the channel 80 comprises a base 82, a first resilient channel wall 84 and an opposite second resilient channel wall 86. Channel wall 84 extends from the base 82 to a distal edge 88 and channel wall 86 extends from the base 82 to a distal edge 90. The resilient walls 84 and 86 extend towards each other and are dimensioned such that the distance between the distal edges 88 and 90 is less than the diameter of the conductor 26. In those instances where the conductor 26 is inserted into the bore 24 before the bracket housing 14 is mated with the connector housing 12, such feature will allow the length 76 to snap into the channel 80 as the bracket housing is mated to the connector housing in the first mode. In addition, such feature provides structure that firmly fixes the second length of the elongated conductor in place and thereby prevents any axial movement of the conductor.

Figure 3:
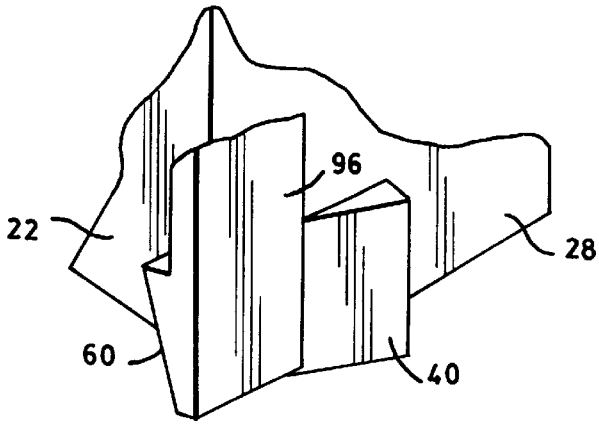
FIGS. 3–5 are perspective views illustrating the rotational movement of the bracket to achieve latching.
Figure 4:
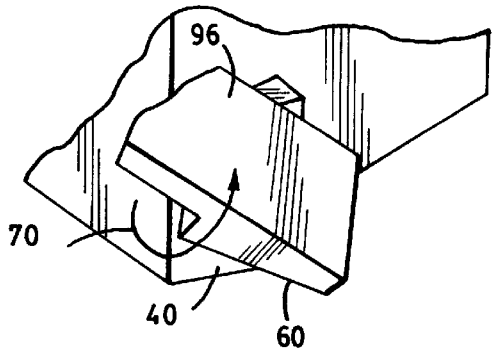
Figure 5:
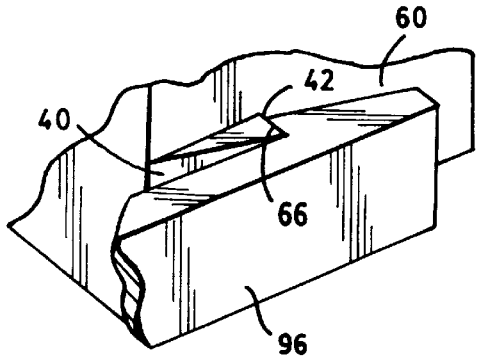

In order to facilitate the camming of the pins 56 by the ramps 32, the side walls 52 and 54 comprise opposing resilient legs 92 and 94. The opposing pins 56 extend into the cavity 58 of the bracket housing 14 from respective legs 92 and 94. Similarly, in order to facilitate the camming of the ramps 60 by the ramps 40, the side walls 52 and 54 comprise opposing resilient legs 96 and 98. The opposing ramps 60 extend into the cavity 58 of the bracket housing 14 from respective legs 96 and 98. In considering the operation of the bracket assembly 10, reference is directed to FIGS. 3–5. In particular, FIG. 3 is a non-exploded view of a portion of the assembly illustrated in FIG. 1. Therein, it will be seen that at the beginning of the second mode the mating camming surfaces 60 will be adjacent the respective camming surfaces 40. The ramps 40 and 60 are structured and arranged such that relative movement in the direction 70 between the connector housing 12 and the bracket housing 14 will cause ramp 60 to slide along ramp 40. This movement is diagrammatically illustrated in FIG. 4. This movement is permitted because of the resilience of the opposing legs 96 and 98. The resilience of the legs 96, 98 permits the ramps 60 to be cammed away from each other by respective ramps 40 due to the contact between ramps 40 and 60 during rotation in the direction 70. The ramps 40 and 60 are also structured and arranged such that rotation in direction 70 will continue until the latch walls 66 are positioned to snap against respective latch walls 42 as the resilient legs 96, 98 resile back towards each other to their original, non-flexed orientation, as illustrated in FIGS. 2 and 5.

The bracket assembly of the present invention may be easily used in locations where access is not readily available. For example, the bracket assembly 10 may be easily used in the crowded environment of an automobile to attach an antenna coaxial cable at relatively inaccessible locations. To this end, the bracket housing 14 may be attached to the connector housing 12 in the first locked position in the first mode, and the cable may be inserted through the channel 80 and bore 24. The bracket assembly 10 may then be mounted as desired either before or after the bracket housing is rotated in the second mode to the second locked position. If desired, the connector housing may be used without the bracket housing for use in mounting straight conductors. To this end, the conductor is merely inserted through the bore 24 and the conductor housing is mounted as desired.

The embodiments which have been described herein are but some of several which utilize this invention and are set forth here by way of illustration but not of limitation. It is apparent that many other embodiments, which will be readily apparent to those skilled in the art, may be made without departing materially from the spirit and scope of this invention.

I claim:

1. A bracket assembly comprising:

a connector housing extending in a first direction of a first axis from a connector front to a connector rear, said connector housing being structured and arranged to hold in place a first length of elongated conductor extending in said first direction, a first connector side including a first camming surface and an opposite second connector side including a second camming surface, said first connector side including a third camming surface and said second connector side including an opposite fourth camming surface; and a bracket housing extending in a second direction of a second axis from a bracket top to a bracket bottom, a first bracket side including a first mating camming surface and an opposite second bracket side including a second mating camming surface, said first bracket side including a third mating camming surface and said second bracket side including an opposite fourth mating camming surface, said bracket housing mating with said connector housing in (a) a first mode wherein said first camming surface and said second camming surface engage said first mating camming surface and said second mating camming surface, respectively, sliding being incurred therebetween to first locked positions, and (b) a second mode wherein (1) said first mating camming surface and said second mating camming surface are rotated relative to said first camming surface and said second camming surface, respectively, said bracket housing thereby bending a second length of said elongated conductor extending from said connector housing at said rear until said second length extends in a third direction of a third axis relative to said first direction, said third axis extending at an angle relative to said first axis, and (2) said third camming surface and said fourth camming surface engage said third mating camming surface and said fourth mating camming surface, respectively, sliding being incurred therebetween to second locked positions.

2. The bracket assembly of claim 1 wherein said housing includes a bore extending in said first direction from said connector rear to said connector front, said bore being structured and arranged to contain said first length of elongated conductor.

3. The bracket assembly of claim 1 wherein said bracket housing further includes an arm extending in said second direction from said bracket bottom, said arm comprising a channel extending in said second direction, said channel being structured and arranged to contain said second length of said elongated conductor.

4. The bracket assembly of claim 3 wherein said channel comprises a base, and first and second resilient channel walls extending from said base to respective first and second distal channel wall edges, said first and second resilient channel walls extending towards each other, the distance between said first and second distal channel wall edges being less than a diameter of said elongated conductor.

5. The bracket housing of claim 1 wherein said angle is about 90°.

6. The bracket assembly of claim 5 wherein said housing includes a bore extending in said first direction from said connector rear to said connector front, said bore being structured and arranged to contain said first length of elongated conductor.

7. The bracket assembly of claim 1 wherein said first and second canning surface extend from a connector top towards a connector bottom, and said third and fourth camming surfaces extend from said connector rear towards said connector front.

8. The bracket assembly of claim 7 wherein said first mating canning surface includes a first pin extending into said bracket housing from said first bracket side towards said second bracket side, and said second mating camming surface includes a second pin extending into said bracket housing from said second bracket side towards said first bracket side, and further wherein said first camming surface includes a first ramp which extends outwardly from said connector top to a first locking recess, and said second camming surface includes a second ramp which extends outwardly from said connector top to a second locking recess, said first pin and said second pin engaging said first ramp and said second ramp, respectively, and sliding in relation thereto to said first locked positions at said first locking recess and said second locking recess, respectively, in said first mode.

9. The bracket assembly of claim 8 wherein said first bracket side includes a first resilient leg and said second bracket side includes an opposite second resilient leg, said first pin and said second pin extending into said bracket housing from said first resilient leg and said second resilient leg, respectively.

10. The bracket assembly of claim 8 wherein said third mating camming surface includes a third ramp which extends into said bracket housing from said first bracket side towards said bracket rear to a first latch wall and said fourth mating camming surface includes a fourth ramp which extends into said bracket housing from said second bracket side towards said bracket rear to a second latch wall, and further wherein said third camming surface includes a fifth ramp and said fourth camming surface includes a sixth ramp, said fifth and sixth ramps extending away from each other, said fifth ramp extending towards said connector front to a third latch wall and said sixth ramp extending towards said connector front to a fourth latch wall, said third ramp and said fourth ramp engaging said fifth ramp and said sixth ramp, respectively, and sliding in relation thereto in said second mode, and said first latch wall engaging said third latch wall and said second latch wall engaging said fourth latch wall in said second locked positions.

11. The bracket assembly of claim 10 wherein said first bracket side includes a third resilient leg and said second bracket side includes an opposite fourth resilient leg, said third ramp and said fourth ramp extending into said bracket housing from said third resilient leg and said fourth resilient leg, respectively.

* * * * *